US005377069A

United States Patent [19]

Andréasson

[11] Patent Number: 5,377,069

[45] Date of Patent: Dec. 27, 1994

[54] OSCILLATING CIRCUIT FOR THE ELIMINATION/REDUCTION OF STATIC ELECTRICITY

[76] Inventor: Tomas Andréasson, Mörtebolsgatan 15, S-662 00 Amal, Sweden

[21] Appl. No.: 90,241

[22] Filed: Jul. 7, 1993

Related U.S. Application Data

[63] Continuation of Ser. No. 761,825, Sep. 12, 1991, abandoned.

[30] Foreign Application Priority Data

Apr. 7, 1989 [SE] Sweden ..... 8901253-8

[51] Int. Cl.[5] ..... H05F 3/02

[52] U.S. Cl. ..... 361/221; 361/212; 361/214

[58] Field of Search ..... 331/57, 177 R, 60, DIG. 3; 361/212–214, 219–222, 225, 229, 235

[56] References Cited

U.S. PATENT DOCUMENTS

| | | | |
|---|---|---|---|
| 3,141,139 | 7/1964 | Mills et al. | 331/57 X |
| 3,395,362 | 7/1968 | Sutherland | 331/57 X |
| 3,428,913 | 2/1969 | Pechoucek | 331/57 X |
| 3,670,203 | 6/1972 | Whitmore, Jr. et al. | 361/225 |
| 3,806,741 | 4/1974 | Smith | 331/57 X |
| 4,091,335 | 5/1978 | Giolma et al. | 331/57 X |
| 4,306,271 | 12/1981 | Weber | 361/235 X |
| 4,333,124 | 6/1982 | Tamura et al. | 361/214 |
| 4,486,808 | 12/1984 | Cardone | 361/235 |
| 4,579,441 | 4/1986 | Hart et al. | 361/214 X |
| 4,729,057 | 3/1988 | Halleck | 361/213 |
| 4,862,015 | 8/1989 | Grandfield | 307/270 |
| 4,920,322 | 4/1990 | Ruijis | 331/57 X |

FOREIGN PATENT DOCUMENTS

| | | | |
|---|---|---|---|
| 402338 | 4/1990 | European Pat. Off. | 361/214 |
| 3147222A | 8/1983 | Germany | 331/57 |
| 645292 | 1/1979 | U.S.S.R. | 361/213 |

OTHER PUBLICATIONS

Graf, Rudolf F.; "The Encyclopedia of Electronic Circuits"; TAB Books Inc.; 1985; Blue Ridge Summit, Pa.; pp.612, 613.

*Primary Examiner*—A. D. Pellinen
*Assistant Examiner*—Fritz M. Fleming
*Attorney, Agent, or Firm*—Nikaido, Marmelstein, Murray & Oram

[57] ABSTRACT

The invention relates to an oscillating circuit for the elimination or reduction of static electricity which is generated in material (1) of machines for treatment or handling or in electrical apparatuses, the oscillating circuit consisting of an electrical circuit, which together with a discharger (2) is included in a unit for discharging static electricity. The oscillating circuit includes a feedback looped inverter (4) consisting of one inverter unit or more inverter units connected in parallel or a feed-back looped series of inverters connected in series, each inverter consisting of either one inverter or a plurality of inverter units connected in parallel, each inverter including one or more transistors. The amplitude of the voltage of the potential oscillation which is transmitted to the discharging means (2), amounts to between 0.1 and 100 V and preferably to between 2 and 15 V.

12 Claims, 5 Drawing Sheets

OSCILLATING CIRCUIT FOR THE ELIMINATION/REDUCTION OF STATIC ELECTRICITY

This application is a continuation of application Ser. No. 07/761,825 filed Sept. 12, 1991, now abandoned.

TECHNICAL FIELD

Oscillating circuit for the elimination of static electricity which is generated in the material of machines for treatment or in handling equipment or in electrical apparatuses, the oscillating circuit consisting of an electrical circuit, which together with a discharger is included in a unit for discharging static electricity.

STATE OF THE ART

It is known to place e.g. earthed brushes of carbon fibre close to a charge generating moving material web in order to eliminate or to reduce static electricity. With such an arrangement, which might be designated as passive ionizator, charges with a field intensity in the order of 5000 V/m can be neutralized to a certain extent. The spontaneous ionization stops, however, when the field intensity is reduced to about 1000 V/m. Thus a complete elimination of charges can not be achieved with a passive ionizator.

The brushes of carbon fibre can, however, be connected to electrical circuits thus permitting the discharge of static electricity at lower field intensities.

Such circuits are known e.g. by the Swedish published patent application No. 435 778. These earlier known circuits include special components, such as tunnel diodes. Such diodes are expensive and they have special current-voltage characteristics. Further, the components are more sensitive to electrical current load and heat load.

Thus, these known circuits are expensive with regard to acquisition and when it comes to maintenance.

A further disadvantage connected with known circuits is that they do not permit a stable frequency adjustment. This frequently implies that it can not be warranted that installations with these circuits can be kept outside the limits reserved for radio and signal traffic. According to rules and regulations and with regard to general security this traffic must not be disturbed.

Tunnel diodes and other special components are not readily available on the market due to the fact that they are used for special purposes. The choice among such components is thus limited. The circuit which is intended to eliminate static electricity must thus be adapted to components which are available and this implies a limitation when designing a circuit intended to solve a diversity of problems connected with static electricity.

BRIEF DESCRIPTION OF THE INVENTION

The aim of the present invention is to achieve an improved circuit of the type initially described. The improvement, which in this connection in the first place is aimed at, is to eliminate the disadvantages connected with installations according to prior art. Particularly, it is an object of the inventor to provide a discharger of static electricity, which is active also in the presence of small charges. This purpose is achieved with the device according to the invention, therein that the device includes a feed-back looped (feed-back connected) inverter consisting of one inverter unit or a plurality of inverter units connected in parallel or a feed-back looped series with an uneven number of inverters connected in series, each inverter consisting of either one inverter or several inverters connected in parallel, each inverter including one or more transistors, the amplitude of the voltage of the potential oscillation, which is transmitted to the discharger, being between 0.1 and 100 V and preferably between 2 and 15 V.

Further characteristics and aspects of the invention as well as its advantages will become apparent from the following description and claims.

BRIEF DESCRIPTION OF THE DRAWINGS

In the following description reference will be made to the following drawings, showing FIG. 1 a simple circuit-diagram of an inverter, FIG. 2 a simple circuit intended for the discharge of static electricity, the circuit including one feed-back looped inventer, FIG. 3 a circuit for the same purpose as the circuit according to FIG. 1 but with a feed-back looped series of three-inverters, FIG. 4 a circuit for the same purpose as the circuit according to FIG. 1 but with a feed-back looped series of three inverters, the feed-back looped series being connected in series with three inverters connected in parallel, FIG. 5 a diagram showing the interrelation between time and potential in a point in the oscillating circuit according to FIG. 2, FIG. 6 a diagram showing the interrelation between time and potential in a point in the oscillating circuit according to FIG. 3 or FIG. 4, FIG. 7 a circuit which corresponds to the circuit according to FIG. 4 but has been completed with two resistors, and FIG. 8 a circuit according to FIG. 4 with one of the inverters of the feed-back looped series of three inverters consisting of an oscillator.

DESCRIPTION OF A PREFERRED EMBODIMENT

Figure 2:
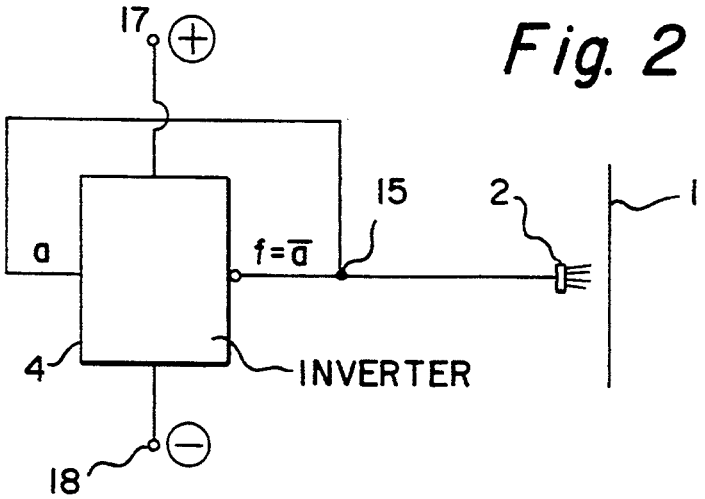
Figure 3:
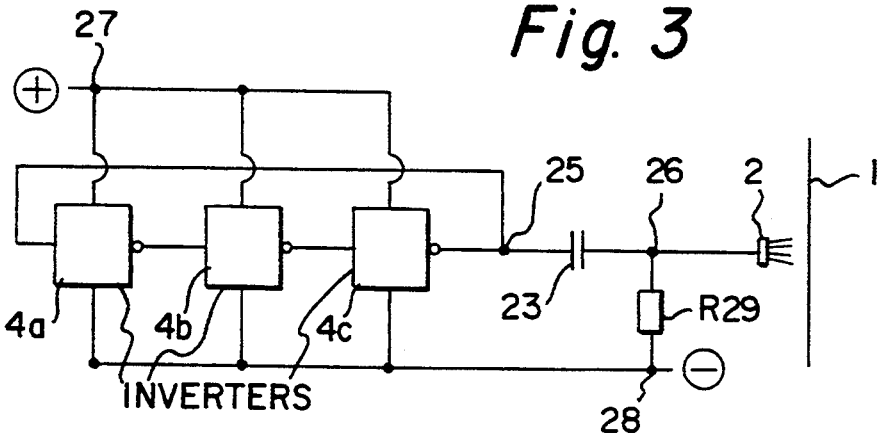
Figure 4:
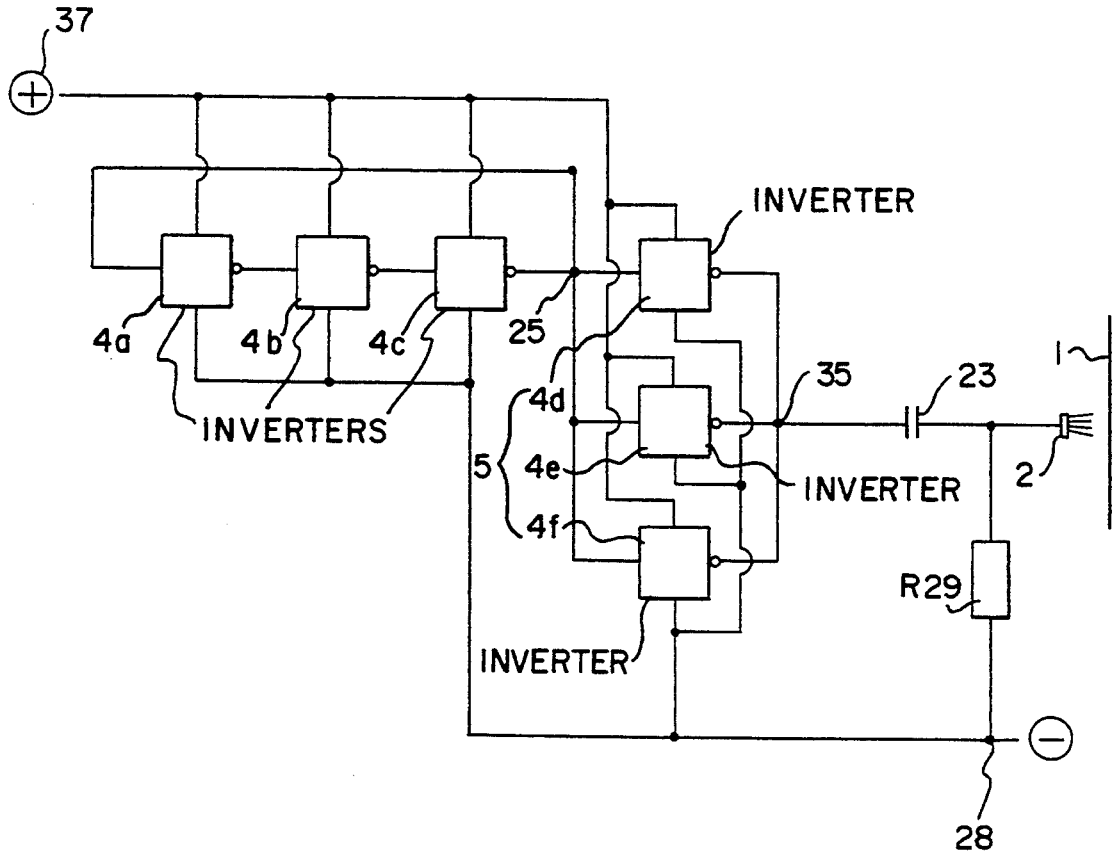

With reference to the drawings, dischargers consisting of a brush of carbon fibre are generally designated 2. The brush of carbon fibre 2 may e.g. have the form of a long slim brush, which, with the bristles directed against a moving material web 1, parallels the plane of the web and is placed at right angles to the direction of movement of the web. The carbon fibre brush can either sweep along the web or be mounted at a distance of e.g. 1.5 cm from the web. As shown in FIG. 2, 3 and 4, the brush 2 is connected to an electric circuit by means of a conductor. The carbon fibre brush functions as a discharging means, placed close to the charged web, said discharging means being intended to lift off charges from the web on which they are stored. The electrical circuit is unstable, as a result of its design with an uneven number of inverters which are connected in series, and feed-back looped (connected), thus tending to self-oscillate with a certain self-frequency between an upper and a lower potential level.

If the carbon fibre brush is placed at a moderate distance of e.g. 15 mm from the web passing by, which is loaded with static electricity, charges are induced at the points of the bristles of the brush. These charges produce a field strength which periodically is magnified due to the connection with the self-oscillating circuit. The electrical resistance of the air gap is thus exceeded resulting in a spontaneous ionization and a transfer of positive or negative charges between the moving web and the carbon fibre brush. The charges can also be transferred directly with a carbon fibre brush in direct contact with the moving web passing by.

Figure 1:
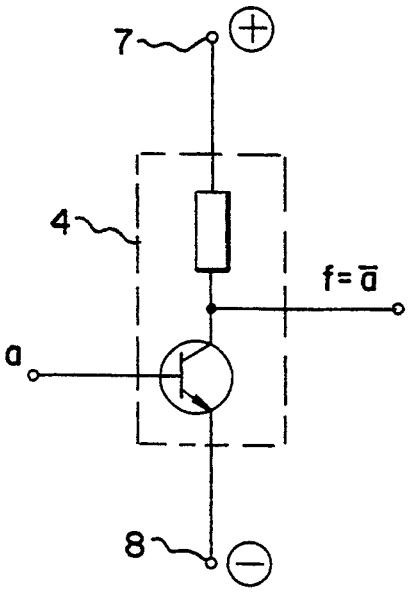

The circuit according to FIG. 2, 3 and 4 are composed of inverters. A simple circuit diagram for an inverter is shown in FIG. 1. This inverter is designed in such a way that when the potential is high at the input terminal a, the potential is low at the output terminal f. When the potential is low at the input a, then the potential will be high at output f. In the simple version shown in FIG. 1, the inverter consists of a resistor and a transistor.

An oscillating circuit is obtained when connecting the output f with the input a of an inverter. The circuit has a certain self-frequency which is dependent on the time-lag between a signal-shift at the input a and the corresponding signal-shift at the output f.

In Fig. 2, a simple feed-back looped inverter 4 is shown. If a voltage of 4 V is applied between terminals 17 and 18, the inverter 4 is activated and due to the feed-back between the output f and the input a, the feed-back circuit will oscillate with a frequency which depends on the time-lag between a signal-shift at the input a and the corresponding signal-shift at the output f. This time-lag is approximately 1.5 ns, which gives a frequency of about 300 MHz.

Figure 5:
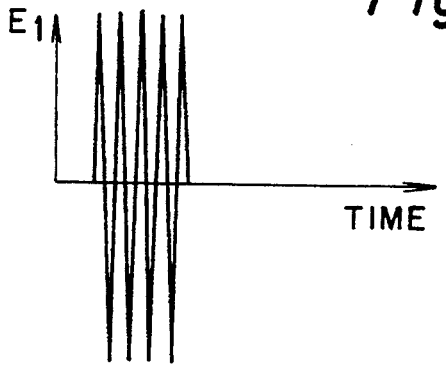

The carbon fibre brush 2 is connected to the oscillating circuit at a connection point 15. If the inverter is activated, the potential at the connection point will vary as shown in the diagram in FIG. 5, thus varying between a higher and a lower potential level with a median potential corresponding essentially to the potential of the connection point 18. Assuming that the signal time-lag of the inverter 4 is 1.5 ns, a potential variation will be obtained at the bristle points of the brush, which potential variation is symmetrical in relation to the potential of the connection point 18 and has a frequency of 333 MHz. If the potential of 4 V is supplied to the inverter between the connection points 17 and 18, then the amplitude of the variation of voltage at the connection point 15 and at the bristle points will be in the region of 1.5–2 V. The voltage at the bristle points should generally be such as to make it possible to touch the bristles of the brush. Some preferred ranges are between 2 V and 15 V, and between 2.5 V and 3.5 V.; The voltage should thus normally not exceed 15–20 V. For special installations, a voltage above 100 V may be provided. Depending on the material of the moving web, the points of the bristles can be placed at a distance reaching about 50 cm, from the moving web, whilst the high frequency variation discharges positive as well as negative charges from the web.

The potential at the connection point 18 will be the reference potential to which the potential level of the moving web will be adjusted. If e.g. the moving web 1 is running in a machine with a metal structure and if it is desirable to adjust to potential level of the moving web to the potential of the structure then the connection point 18 should be connected to the structure. However, this is not necessary if the connection point 18 is maintained at a desired potential level by means of the voltage supply to the inverter. An artificial ground connection can thus be obtained.

It has become apparent in connection with various applications that a better discharge of static electricity can be obtained with a circuit with a lower frequency than the frequency that can be obtained with only one feed-back looped inverter. A preferable embodiment is obtained with a circuit according to FIG. 3. The circuit in question consists of three inverters connected in series. The output of the first inverter **4*a* is connected to the input of the second inverter 4*b* and the output of this inverter is connected to the input of the third inverter 4*c*. Further, the output of the third inverter 4*c* is connected to the input of the invertar 4*a* . The voltage is supplied to the three inverters between the terminals 27 and 28**.

Each one of the inverters 4 in the circuit according to FIG. 3 can consist of either one inverter or several inverter units connected in parallel. When using several inverter units connected in parallel, a more extensive output signal is obtained due to variations in time-lag between the different units.

The circuit according to FIG. 3 has furthermore been supplemented with an RC-circuit. A capacitor 23 has thus been connected between the brush 2 and the connection point 25, and a resistor 29 has been connected between, on the one side a connection point 26 between the brush 2 and the capacitor 23 and on the other side the connection point 28.

The connection in series of the inverters **4*a* , 4*b* and 4*c* implies that the time-lag between a signal-shift at the input of the inverter 4*a* and the corresponding signal-shift at the output of the inverter 4*c* is three times larger than the time-lag between a signal-shift at the input a of a single inverter and the corresponding signal-shift at the output of the inverter. The three inverters 4*a*, 4*b* and 4*c*** will thus have the same mode of functioning as a simple inverter, but the time-lag between a signal-shift at the input and the corresponding signal-shift at the output will be tripled.

The time-lag can be increased with further inverters connected in series but the number of inverters must be uneven if the inverter function is to be maintained. If the same inverters are used for the circuit according to FIG. 3 as the one used for the circuit according to FIG. 2 an oscillating circuit will be obtained in the feed-back looped circuit between the output **4*c* of the inverter and its input 4*a***. The oscillating circuit will have a self-frequency which is one third of the self-frequency of the circuit according to FIG. 2. The self-frequency will thus be about 100 MHz, if the time-lag between the signal-shift at the input a and the corresponding signal-shift at the output f of a single inverter is about 1.5 ns. Preferred ranges of this frequency are between 500 Hz and 500 MHz, or between 75 MHz and 750 MHz. A preferred time constant of this RC circuit is between 1/10 and 2/3 of a period of the oscillation of the electric circuit, or between 5% and 30% thereof.

The RC-circuit, which includes a capacitor 23 and the resistor R29, is influenced by the oscillations in the feed-back circuit in such a way that the voltage over the capacitor increases or decreases in connection with each signal-shift, whilst the rate of change of voltage increase or decrease, respectively, is reduced between the signal-shifts. The voltage or potential difference over the resistance R29 is equal to the difference between on the one side the difference in voltage between the points of connection 25 and 28 and on the other side the voltage over the capacitor 23. The difference in potential E2 between the connection points 26 and 28 will thus vary according to the diagram shown in FIG 6. The potential level at the brush 2 with thus also vary according to the graph in FIG. 6.

Figure 6:
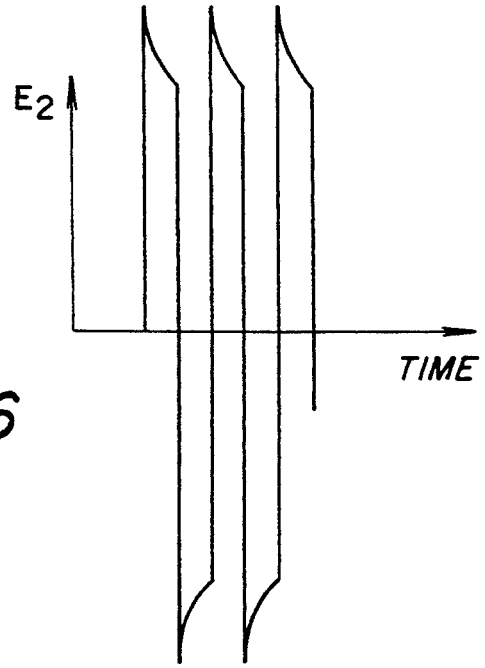

A condition for obtaining the voltage peaks at maximum and minimum potential, shown in FIG. 6, is that the time constant of the RC-circuit is of the same magnitude as half the period of the self-oscillation of the feedback circuit. In a preferred embodiment, the resistor R has a resistance of 1 megohm and the capacitance C of the capacitor is 1 nanofarad. A preferred capacity is between 0.1 nanofarads and 2.0 microfarads, and more particularly between 0.5 and 1.5 nanofarads.

At the points of the carbon fibre brush, a variation of potential level is obtained with extremes essentially symmetrically disposed in relation to the potential level at the connection point 28. If for example, the moving web is located in a machine with a metal structure and if it is desirable to adjust a potential level of the moving web to the structure, then the connection point 28 can be connected to the machine structure. This is, however, not necessary if the connection point 28 is maintained at a desired potential level by means of the voltage supply to the inverter. An artificial ground connection can thus be obtained.

It has been shown that the potential variation at the brush 2 with the graph having painted extremes of potential shown in FIG. 6, considerably contributes to the capability of the discharge circuit to discharge static electricity.

The circuit according to FIG. 4 includes not only a feed-back looped series containing three inverters but also a block consisting of three inverters connected in parallel. The circuit according to FIG. 4 can be obtained by connecting a block consisting of three inverters connected in parallel between the connection point 25 and the capacitor 23. In the circuit according to FIG. 4, the feed-back looped series of three inverters connected in series has the function of a pulse generator. The potential at the common output terminal 35 of the three inverters connected in parallel, will oscillate with a phase displacement but at the same pace as the feedback looped series of inverters. With the circuit according to FIG. 4, a potential variation, which corresponds to the one obtained with a circuit according to FIG. 3 and shown in FIG. 6, is obtained at the carbon fibre brush 2. With the circuit according to FIG. 4 power is increased substantially at the same time. This may be desirable if one for example wants to connect several carbon fibre brushes to the same circuit.

The carbon fibre brush can be replaced by foils or by a film, and the carbon material can be replaced by other conducting materials.

Figure 7:
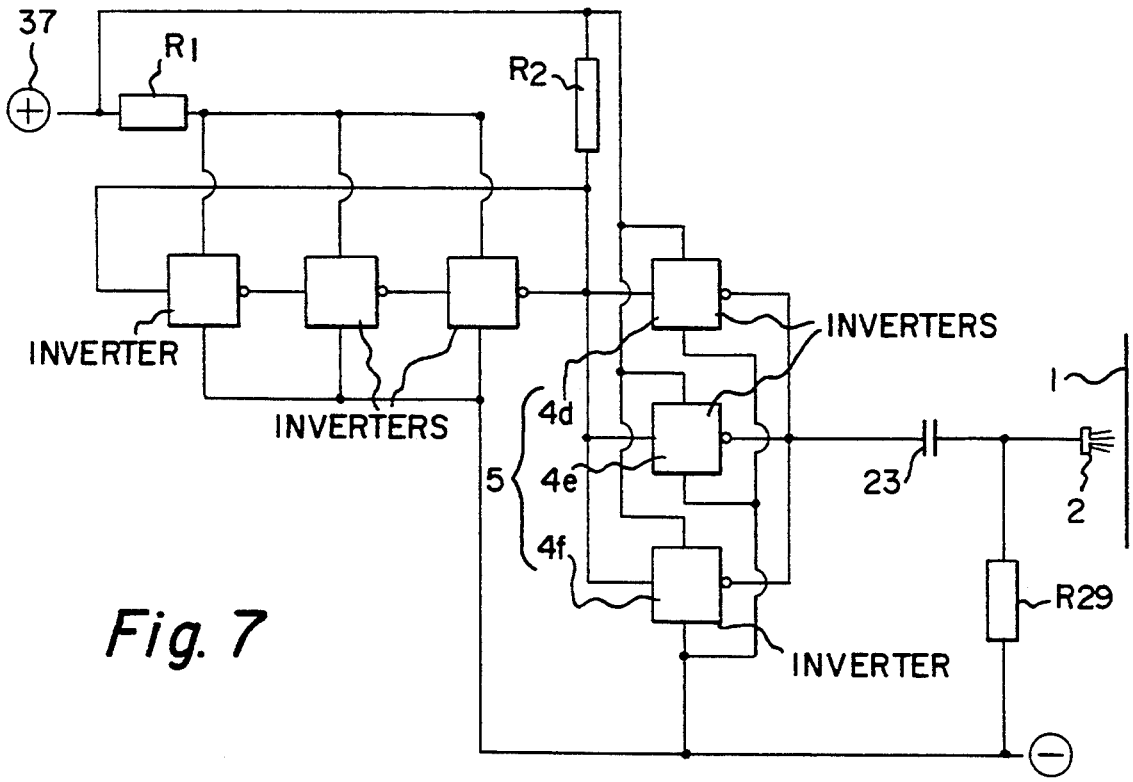

As shown in FIG. 7, the circuit according to FIG. 4 has been supplemented with a resistor R1 for the adjustment of frequency and amplitude. Furthermore, the circuit according to FIG. 4 has been supplemented with a resistor R2 with a pull-up function in order to amplify the output current.

Figure 8:
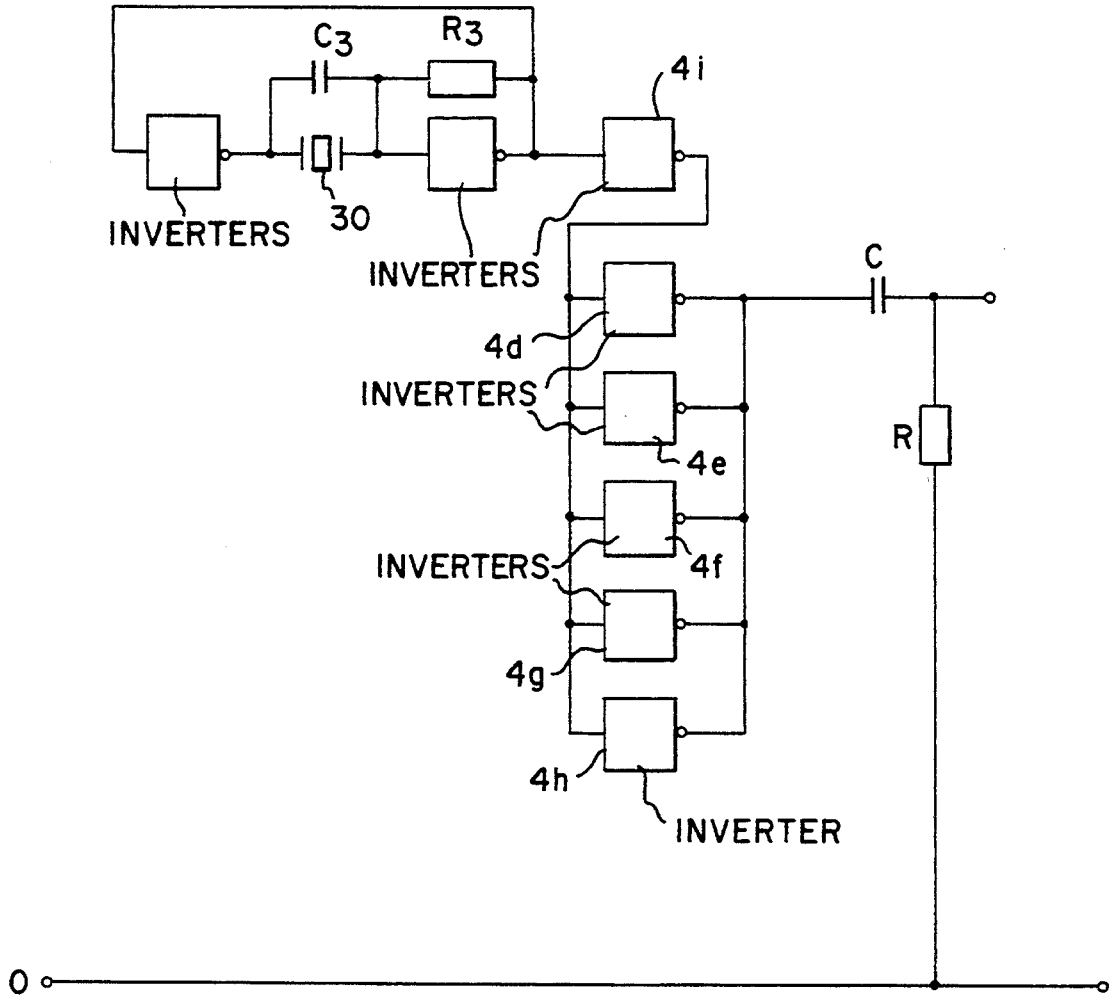

In FIG. 8 there is shown a circuit, which is intended for use in applications requiring that a warranty is given that e.g. certain ranges of frequency will not be disturbed. This generally implies that the circuits included in the equipment must show a considerable stability in frequency. The circuit according to FIG. 8 is in principle designed as the circuit according to FIG. 4. The block with three inverters connected in parallel has, in the circuit according to FIG. 8, been supplemented with further inverters 4*g* and 4*h* in order to achieve more power. Further, an inverter has been connected between the connection point 25 and the block with five inverters 4*d*, 4*e*, 4*f*, 4*g*, 4*h* connected in parallel in order to reduce the phase displacement between the output frequency and the frequency at the point 23. This implies that checking of the circuit is facilitated in connection with its installation and in connection with maintenance etc. Furthermore, in FIG. 8 one of the inverters of the feed-back looped group of three inverters 4*a*, 4*b*, 4*c* according to FIG. 4 has been replaced by a frequency-stable oscillator 30 with very low damping. The frequency controlling element of the oscillator is a quartz crystal. Thus, there is obtained between the inverters 4*a* and 4*c*, an inverting unit having practically constant and invariable time-lag. The crystal of the oscillator 30 is kept in oscillation at natural frequency by means of the oscillating sequential circuit, which influences the crystal by way of the RC-circuit, which includes the capacitor C3 and the resistor R3.

Figure 9:
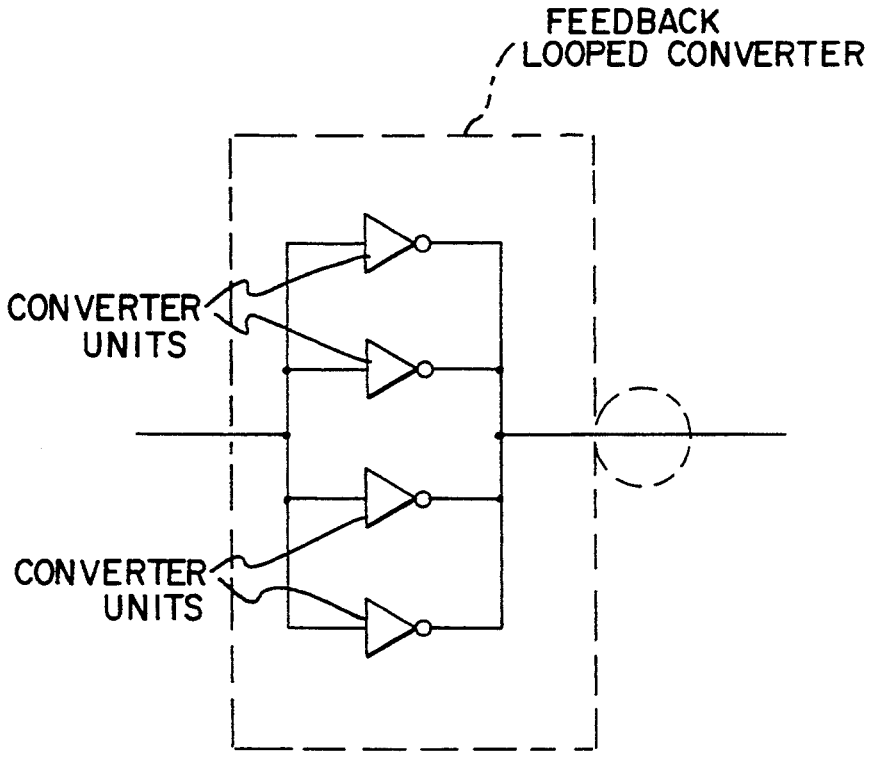
FIG. 9 a feed back looped inverter having four converter units in parallel, as used in FIGS. 2–4, 7 and 8.

FIG. 9 illustrates a feedback looped converter which includes four converter units connected therein. The converter units of FIG. 9 are shown as being connected in parallel.

The inverters need not to be designed according to FIG. 1. The inverting functions can also be obtained using NAND-gates, with an input terminal connected to the supply.

Other modifications of the embodiment of the invention than those described above may be conceived within the spirit and scope of the present invention as defined by the appending claims.

I claim:

1. An oscillating circuit for the elimination and reduction of static electricity generated in material (1) of machines for treatment for handling in electric apparatuses, said oscillating circuit comprising:

a discharger for discharging static electricity from a material, said discharger comprising a brush of carbon fiber;

an electric circuit coupled to said discharger, said electric circuit including a feedback looped inverter, said inverter including at least one transistor, wherein an amplitude of voltage of a potential oscillation which is supplied to said discharger is between 0.1 and 100 volts, a voltage supplied to the feedback looped inverter is between 2 volts and 15 volts, and an oscillating frequency of the oscillating circuit is between 500 Hz and 500 MHz, said oscillating circuit also comprising an RC circuit having at least one capacitor coupled between said feedback looped inverter and said discharger; and a first resistor coupled to said discharger and a reference point for grounding said electric circuit.

2. An oscillating circuit as recited in claim 1, wherein said inverter comprises an uneven number of first inverter units connected in series.

3. An oscillating circuit as recited in claim 2, wherein one of said first inverter units comprises quartz crystal means for controlling the frequency of the oscillating circuit.

4. An oscillating circuit as recited in claim 1, wherein each of said first inverter units comprises several second inverter units connected in parallel.

5. An oscillating circuit as recited in claim 1, wherein the voltage supplied to the feedback looped inverter is between 2.5 and 3.5 volts.

6. An oscillating circuit as recited in claim 1, wherein a time constant of said RC circuit is between 1/10 and 2/3 of a period of the oscillation of the electric circuit.

7. An oscillating circuit as recited in claim 1, wherein a time constant of said RC circuit is between 5% and 30% of a period of the oscillation of the electric circuit.

8. An oscillating circuit as recited in claim 1, wherein a capacity of said RC circuit is between 0.1 nanofarads and 2.0 microfarads.

9. An oscillating circuit as recited in claim 8, wherein the capacity of the RC circuit is between 0.5 and 1.5 nanofarads.

10. An oscillating circuit according to claim 1, further comprising:

resistor means coupled to said electric circuit for permitting amplitude and frequency adjustment independent of a supply voltage.

11. An oscillating circuit as recited in claim 1, further comprising:

a second resistor coupled to a supply voltage and to the feedback looped inverter and an inverting block (4*d-f*).

12. An oscillating circuit for the elimination and reduction of static electricity generated in material (1) of machines for treatment for handling in electric apparatuses, said oscillating circuit comprising:

a discharger for discharging static electricity from a material, said discharger comprising a brush of carbon fiber;

an electric circuit coupled to said discharger, said electric circuit including a feedback looped inverter, said inverter including at least one transistor, wherein an amplitude of voltage of a potential oscillation which is supplied to said discharger is between 0.1 and 100 volts, a voltage supplied to the feedback looped inverter is between 2 volts and 15 volts, and an oscillating frequency of the oscillating circuit is between 75 MHz and 750 MHz, said oscillating circuit also comprising an RC circuit having at least one capacitor coupled between said feedback looped inverter and said discharger; and a first resistor coupled to said discharger and a reference point for grounding said electric circuit.

* * * * *

UNITED STATES PATENT AND TRADEMARK OFFICE

CERTIFICATE OF CORRECTION

PATENT NO. : 5,377,069
DATED : December 27, 1994
INVENTOR(S) : Tomas Andreasson

It is certified that error appears in the above-indentified patent and that said Letters Patent is hereby corrected as shown below:

On the title page, item [63], after "Sep. 12, 1991," after abandoned insert --which was the national stage of international application number PCT/SE90/00197 filed March 28, 1990, Signed and Sealed this Twenty-ninth Day of August, 1995

*Attest:*

BRUCE LEHMAN

*Attesting Officer*

*Commissioner of Patents and Trademarks*